United States Patent [19]

Methot

[11] Patent Number: 4,864,917

[45] Date of Patent: Sep. 12, 1989

[54] ROTARY CYLINDER DISPLACEMENT MECHANISM

[76] Inventor: Hector F. Methot, 3111 Capelaw Ct., San Jose, Calif. 95135

[21] Appl. No.: 934,921

[22] Filed: Nov. 26, 1986

[51] Int. Cl.[4] ..... F01C 9/00; F01B 13/00

[52] U.S. Cl. ..... 92/55; 92/117 R; 92/117 A; 92/121; 244/102 R

[58] Field of Search ..... 92/55, 57, 117 R, 117 A, 92/120, 121, 122, 123, 124, 125; 244/102 R

[56] References Cited

U.S. PATENT DOCUMENTS

| | | | |
|---|---|---|---|
| 1,042,883 | 10/1912 | Brown | 92/120 X |
| 2,099,706 | 11/1937 | Richards | 92/121 X |
| 2,148,972 | 2/1939 | Waseige | 244/102 R |
| 2,272,522 | 2/1942 | Hojnowski | 244/102 R |
| 2,404,639 | 7/1946 | Lane | 92/117 A X |
| 2,715,393 | 8/1955 | Lehner | 92/121 X |
| 3,318,201 | 5/1967 | Blake | 92/121 |
| 3,739,519 | 6/1973 | Garabello | 244/102 R |
| 3,750,535 | 8/1973 | Higuchi | 92/121 |
| 4,265,417 | 5/1981 | Watts | 92/122 X |
| 4,398,682 | 8/1983 | Bithrey | 92/2 X |
| 4,526,087 | 7/1985 | d'Agostino et al. | 92/117 A X |

FOREIGN PATENT DOCUMENTS

| | | | |
|---|---|---|---|
| 921721 | 5/1947 | France | 92/117 R |
| 0521251 | 5/1940 | United Kingdom | 244/102 R |

*Primary Examiner*—Robert E. Garrett
*Assistant Examiner*—Mark A. Williamson

[57] ABSTRACT

A one moving part, bi-directional rotary displacement mechanism for conveying rotational movement about an axis to movable members in flight vehicles. In consists of an enclosure having bi-directional rotation capability, encapsulating a vane with bi-directional ducts venting from its load bearing surfaces. The vane is affixed to a bi-directionally ducted shaft, having bi-direcitonal rotation capability, extending through the center and outside of the enclosure. A conically shaped, sealed, positive stop, with load bearing surfaces, eminating from the inside radius of the housing, points toward the horizontal axis, supports the shaft and facilitates axial rotation. The vane has a radius concentric with the inside radius of the enclosure and allows sealed bi-directional rotary movement between the two surfaces. Two sealed cavities exist between the load bearing surfaces of the vane and the positive stop. Pressure to and from the cavities flows through the joined vane and shaft ducting. Ducted pressure filling one cavity and coupled with the second cavity simultaneously venting its pressure produces rotary movement.

2 Claims, 4 Drawing Sheets

ROTARY CYLINDER DISPLACEMENT MECHANISM

BACKGROUND

1. Field of the Invention

This invention relates to flight vehicles, especially flight vehicles requiring bi-directional, rotary movement translated to their movable members.

2. Description of Prior Art

Heretofore flight vehicle mechanisms designed to activate movable surfaces or systems were not simply designed, having one moving part with bi-directional capability. Consistent with a complex or hand powered activation mechanisms came many comprises not desired in flight vehicles.

Example 1 is an aircraft having retractable landing gear disclosed in U.S. Pat. No. 2,272,522 issued on Feb 10, 1942 to Mr. Hojnowski. The operation of the Hojnowski retractable landing gear system is based upon manually operated crank handles (2 men required) transferring force for retraction/extension via beveled gears on fixed shafts, worm wheels and worm shafts. This system has many disadvantages, namely:

1. it does not have one moving part, but several
2. power is provided by crewmen
3. it is impractical in aircraft requiring:
   A. rapid or emergency operation of landing gear
   B. in aircraft with large or multiple retractable landing gear
   C. retractable landing gear systems to be housed in a small area or in the wing only
   D. no crew on board
4. in an age where fuelburn and aircraft weight are critical, this system is much too heavy, slow and cumbersome
5. it is most impractical and in some instances impossible to activate any of the following flight vehicle movable members that said Rotary Cylinder Displacement Mechanism can activate, namely: ailerons, cannards, elevators, flaps, flaperons, flight guidance fins (missile), fully articulating horizontal stabilizer, helicopter blade activating devices, passenger doors, movable fuel flow and air induction systems, rudders, ground steering units, slats , slots, spoilers, speed brakes, thrust reversers, variable geometry wings, vectored thrust units to name many but perhaps not all.

Example 2 is a pressure operated retractable landing gear system, U.S. Pat. No. 3,739,519 issued June 19, 1973 to Garabello et al. It operates by pressure supplied to a piston which moves a piston rod which translates motion to landing gear through a series of collars, links, fastener pins, pivot pins and blocks. This system has many disadvantages and non applications, namely:

1. it is not adaptive or practical as a power source for those flight vehicle movable members listed in Section 5 of Example 1
2. it is not adaptive or practical in aircraft other than model aircraft
3. it has a multiple of moving parts which translates to:
   A. greater expense to manufacture, own, repair, replace
   B. lower useful life, less reliability, more easily subject to breakage
   C. not designed to move heavy loads
4. this linkage, push/pull retraction system does not provide optimum leverage exerted through all degrees of radius of motion. Because of this design weakness, a heavier and larger system is now manufactured
5. if this system could be adapted to larger aircraft a piston rod wiper system would be required
6. as designed, one gear retraction system is required for each retractable landing gear
7. as designed, this mechanism does not produce more than about 90° of movement.

Example 3 is a displacement mechanism disclosed in U.S. Pat. No. 4,398,682 issued on Aug. 16, 1983 to Mr. Bithrey. Fluid pressure operates a two part system separated by valves. In the first segment, pressure is introduced through ducts venting from two movable vanes into two cambers. Pressure in the chambers cause radial movement along the axis of the motor. The housing of the motor rotates approximately 90° to position the attached fin perpendicular to the missile surface. An alternate set of chambers, flanges and valves located in the forward section of the displacement mechanism provide locking. The disadvantages to this system are:

1. it is a one way system, it is not bi-directional and, therefore, cannot by itself cycle landing gear or any of the movable members outlined in Section 5 of Example 1
2. the displacement mechanism is complex, difficult to manufacture and, therefore, expensive
3. it requires extremely high pressure to operate (10,000 psi recommended)
4. this design does not translate rotory motion through the shaft and or the housing, but just the housing
5. this design cannot translate more than 180° of rotation.

Most users, therefore, would find it desirable to have a one moving part bi-directional rotary mechanism that is versatile, simple, rugged, reliable, inexpensive, light weight and safe.

OBJECTS AND ADVANTAGES

The object of this invention is to provide to the aviation industry, from model manufacturers to manufacturers of the largest and fastest of aircraft, a rotary displacement mechanism powering movable systems and surfaces that will overcome all of the difficulties and disadvantages outlined in the discussion of prior art and more.

The feature that allows this invention to overcome so many problems engendered in the other movable systems is its simplicity. The Rotary Cylinder Displacement System has but one moving part, is bi-directional and bi-translational. Accordingly, we recognize the following advantages:

1. it creates safety through simplicity
2. it does not require crewmen to provide the force to create rotation
3. it can cycle itself rapidly, multiply and reverse direction anywhere along its radius of motion with no loss of safety or efficiency
4. it will have a long service life, be very reliable, durable and difficult to damage or break
5. it is compact, having a high strength to low weight ratio and a low weight to large force produced ratio
6. it will have great versatility and function in soaring, lighter than air, vertical take off aircraft, rotary wing aircraft, fixed wing aircraft or combinations of both; it will operate in rocket powered flight vehicles, small model aircraft, in remotely piloted aircraft, aircraft having the heaviest of landing gear, on landing gear most abused (carrier aircraft), and aircraft that need to position their landing gear at very high flying speeds 7. its size and shape can easily be designed and built to accommodate any space designed for retractable landing gear without loss of efficiency or safety 8. it can rotate one or several landing gear at one time 9. it applies at all times optimum leverage through all degrees of radius of motion; consequently, this invention will not be as large or heavy as its counterparts to produce equal or better results 10. optimum leverage would allow high pressure activation systems to be replaced by a lower pressured system without operational loss; this would reduce costs and aircraft weight 11. because this invention is smaller, when married up with the aforementioned smaller hydraulic system, aircraft can be designed smaller, lighter, more efficient or if left the same size, provide more space and weight for other systems, passengers, cargo and fuel 12. the torque that this invention produces can be translated to one or more movable surfaces and systems through the shaft, the housing or both 13. by changing the size of its vane and positive stop, it can rotate over 240° which will allow it to power other systems before, during or after its primary rotation function is accomplished 14. it requires no levers linkage flexibles, arms, belts, pistons, guides, wheels, worm shafts, worm wheels, gears, cogs, rachet wheels, handles, brackets, lugs, keys, key collars, pins, sockets, blocks, etc., etc. for its operation of a surface or system 15. it is designed with built in positive stops 16. when the strut is fixed to the housing and in the landing position, the invention is mechanically loaded thus, there is no back pressure introduced into the pressure system even when the strut is fully loaded; the mechanical loading occurs because the strut, positive stop, shaft, vane and housing all line up on the center line 17. the invention can be locked up or down by its own pressure system, by positive mechanical means or both 18. by introducing back pressure to this invention positive positioning becomes available for use on the movable members outlined in Section 5 Example 1 of Prior Art 19. this invention has a closed pressure system and when pressurized by fluid becomes self lubricating 20. any steering system can operate in concert with this invention 21. its rugged compactness will allow its installation into aircraft that have already been manufactured with retractable landing gear as well as allowing fixed gear aircraft to be retrofitted with retractable landing gear 22. this invention will be advantageous to the manufacturers and owner/operators in the following ways:

A. exotic building materials are not required
B. it can be simply designed for all types of aircraft
C. the parts are easy to produce—die, die cast, molded, machined
D. less tooling is required
E. fewer man and machine hours required to manufacture and assemble
F. there are few rigid tolerances
G. it is easy to install
H. it will be easy to inspect
I. it will be simple to maintain
J. it will be easy to trouble shoot or repair
K. it will be easy to replace
L. it will reduce aircraft cost of operation
M. it can be the state of the art for years to come.

Further objects and advantages of this invention will become apparant from a consideration of the drawings and ensuing description.

DRAWING REFERENCE NUMBERS

Figure 1:
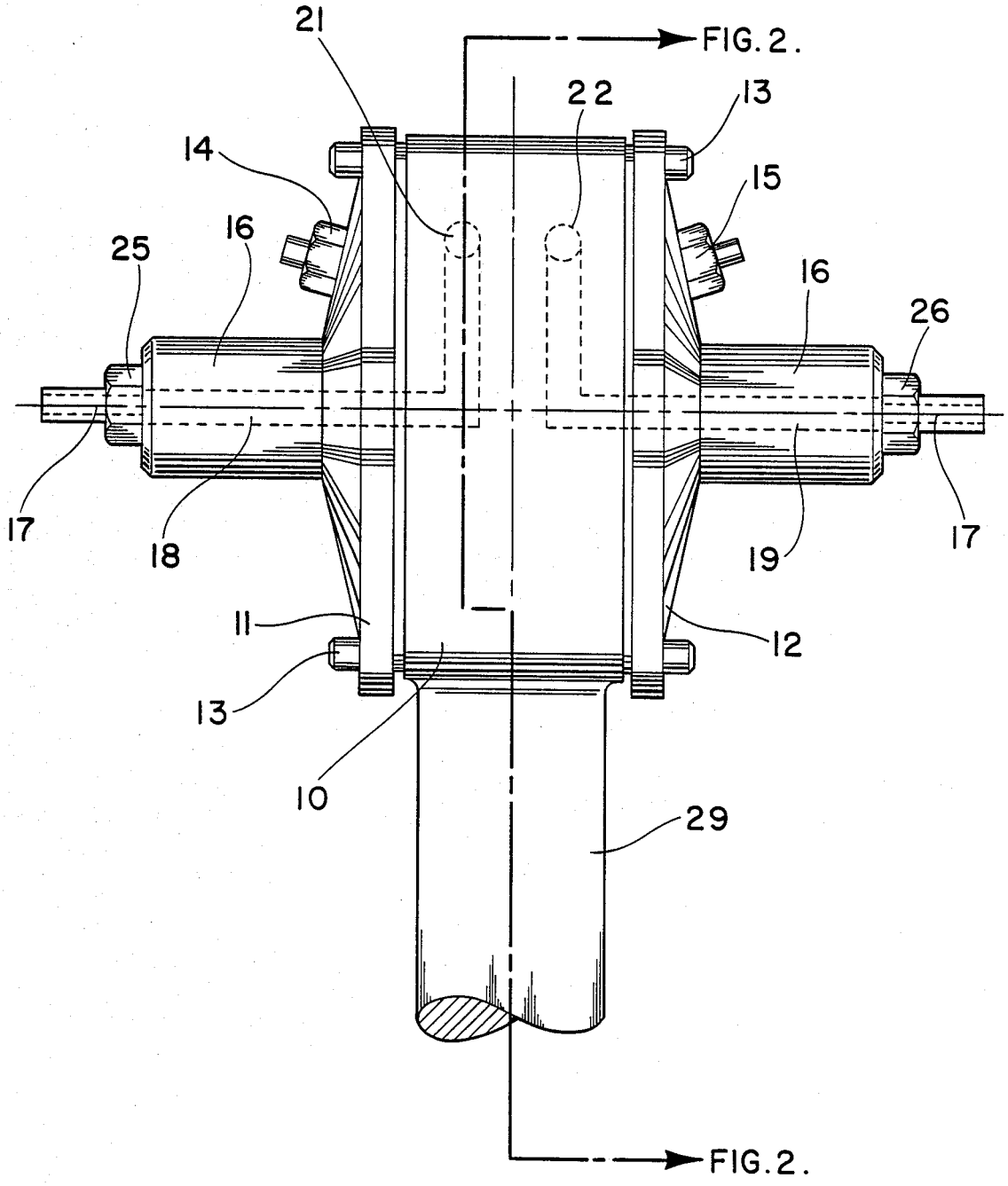
FIG. 1 is a schematic side view of enclosure, shaft and strut.

10 housing
11 endcap A
12 endcap B
13 screw
14 drainline port A
15 drainline port B
16 stationary shaft
17 horizontal axis
18 axial port A
19 axial port B
20 stationary vane
21 stationary vane port A
22 stationary vane port B
23 stationary vane surface A
24 stationary vane surface B
25 hydraulic fitting A
26 hydraulic fitting B
27 positive stop
28 center line
29 strut
30 positive stop surface A
31 positive stop surface B
32 cavity A
33 cavity B
34 seals
35 movable shaft
36 vane port A
37 vane port B
38 retractable landing gear strut
39 bracket
40 bearing blocks

DESCRIPTION OF THE INVENTION

This invention relates to displacement mechanisms for rotating movable members found on flight vehicles. This pressure operated arrangement will be described in two segments, first the outer and non-moving parts and those parts associated with the supply and relief of pressure and the second describing those parts reacting to the introduced pressure.

FIG. 1 shows the enclosure of the invention. It consists of the housing 10 to which endcap A 11 and endcap B 12 are joined by a circumference of screws 13. When the invention is fluid powered, drain line port A 14 in endcap A 11 and drainline port B 15 in endcap B 12 provide venting.

The shaft 16, described as stationary when secured at each end (not shown), extends through the center of endcaps A 11 and B 12 along the horizontal axis 17. Rotation between endcaps A 11 and B 12 and stationary shaft 16 is facilitated by bearings (not shown) which can be located in or near endcaps A 11 and B 12. Axial port A 18 and axial port B 19 have been drilled through the stationary shaft 16 along the horizontal axis 17 and exit the stationary shaft 16 before they meet. The stationary vane 20 (FIG. 2) is fixedly carried by the stationary shaft 16 between endcaps A 11 and B 12 and has ports A 21 and B 22 drilled into it. Axial port A 18, where it exits the stationary shaft 16, joins stationary vane port A 21 and axial port B 19 where is exits the stationary shaft 16 joins stationary vane port B 22. Stationary vane port A 21 opens into stationary vane load bearing surface A 23 and stationary vane port B 22 opens into stationary vane load bearing surface B 24. Hydraulic fittings A 25 and B 26 are attached to outer ends of the stationary shaft 16. All ports and fittings vent bi-directionally.

Figure 2:
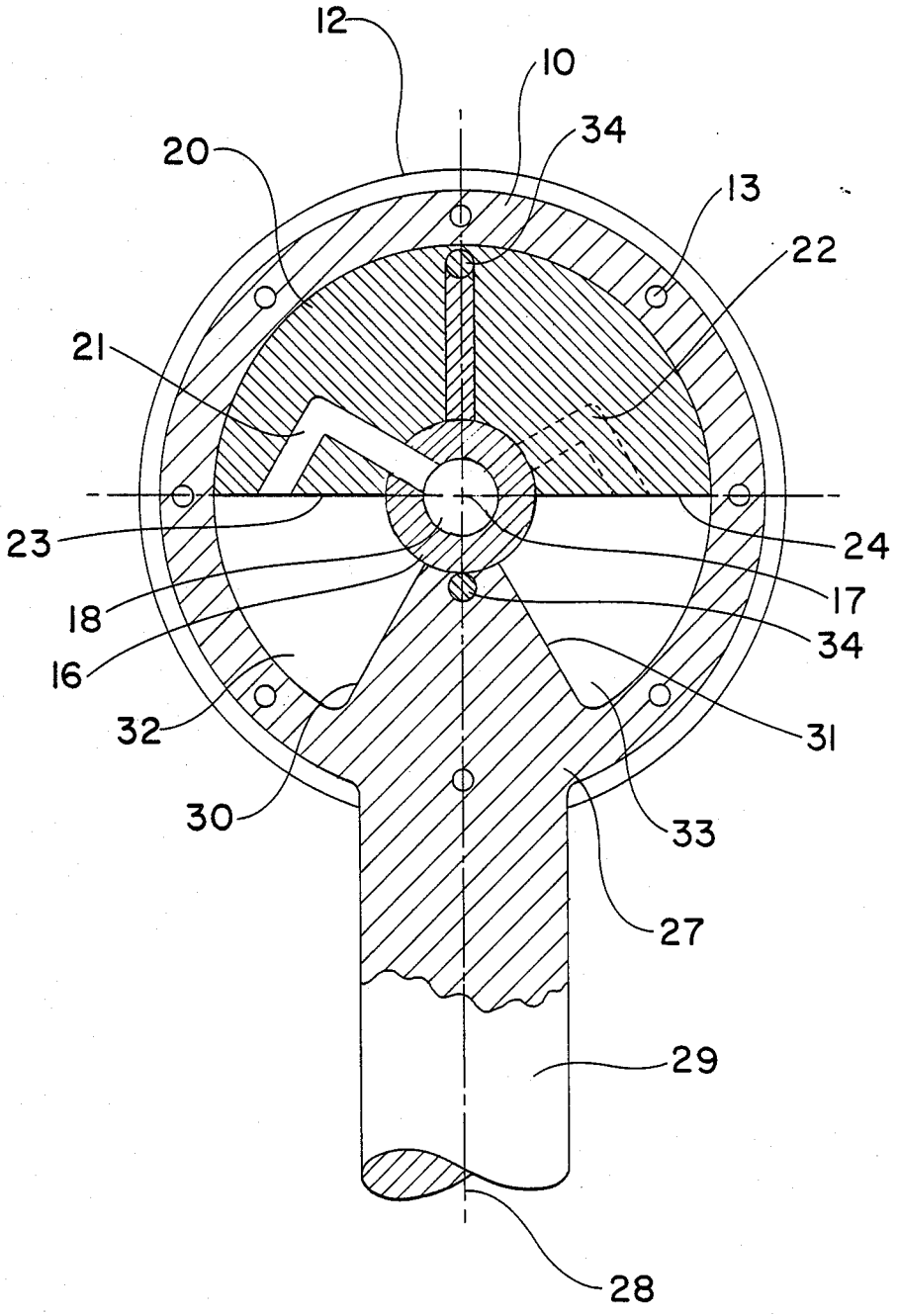
FIG. 2 is a schematic front view of said mechanism along arrowed section line 2—2 shown in FIG. 1.

FIG. 2 is a schematic front view of the invention drawn along arrowed section line 2—2 shown in FIG. 1. It shows the inner workings of the mechanism which includes a conical shaped built in positive stop 27, its apex pointing toward the horizontal axis 17 and its body extending away from said axis 17 along the center line 28 to form the strut 29. Left of center line 28 on the positive stop 27 is positive stop load bearing surface A 30 and right of center line 28 on the positive stop 27 is positive stop load bearing surface B 31. A portion of the inside radius of the housing 10 and all of the outside radius of the stationary vane 20 are concentric and whose sealing engagement allow rotary movement about the horizontal axis 17. The peak of positive stop 27 forms a sealed bearing support for the stationary shaft 16.

The space between stationary vane surface A 23 and positive stop surface A 30 forms cavity A 32. The space between stationary vane surface B 24 and positive stop surface B 31 forms cavity B 33. Seals 34 and seals not shown for the sake of clarity complete the separation of cavity A 32 from cavity B 33.

OPERATION OF ROTARY MECHANISM

Figure 3:
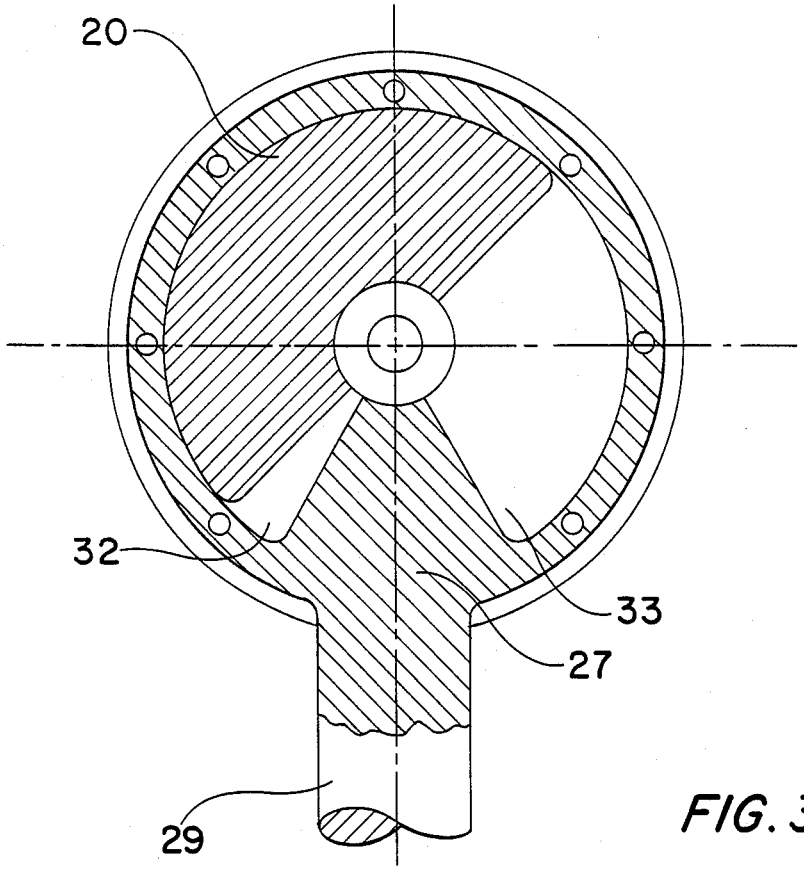
FIG. 3 is a schematic front view of said mechanism nearly to the fully extended position.

For clarity and ease of understanding, the following assumptions are given:

A. that the landing gear strut is in the extended position (closely approximated in FIG. 3)

B. that fluid pressure will power this invention

C. that displacement of the strut will be translated through the housing and the stationary shaft is mounted D. that items noted with A's comprise system A and work in opposite to those items noted with B's and which make up system B E. we now wish to retract the landing gear strut.

Figure 4:
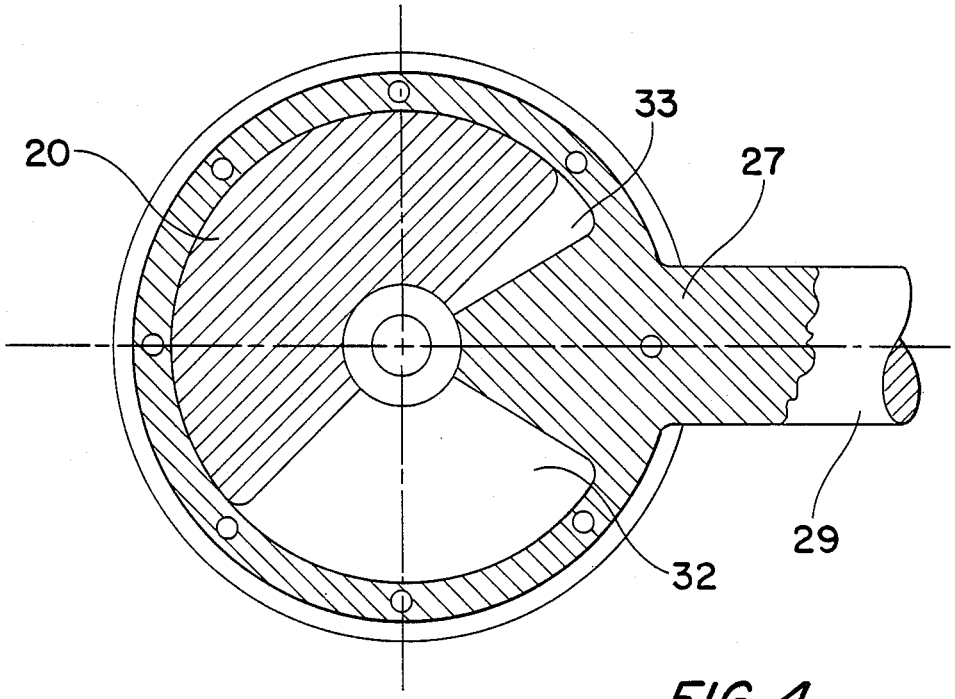
FIG. 4 is a schematic front view of the mechanism nearly to the fully retracted position.
Figure 5:
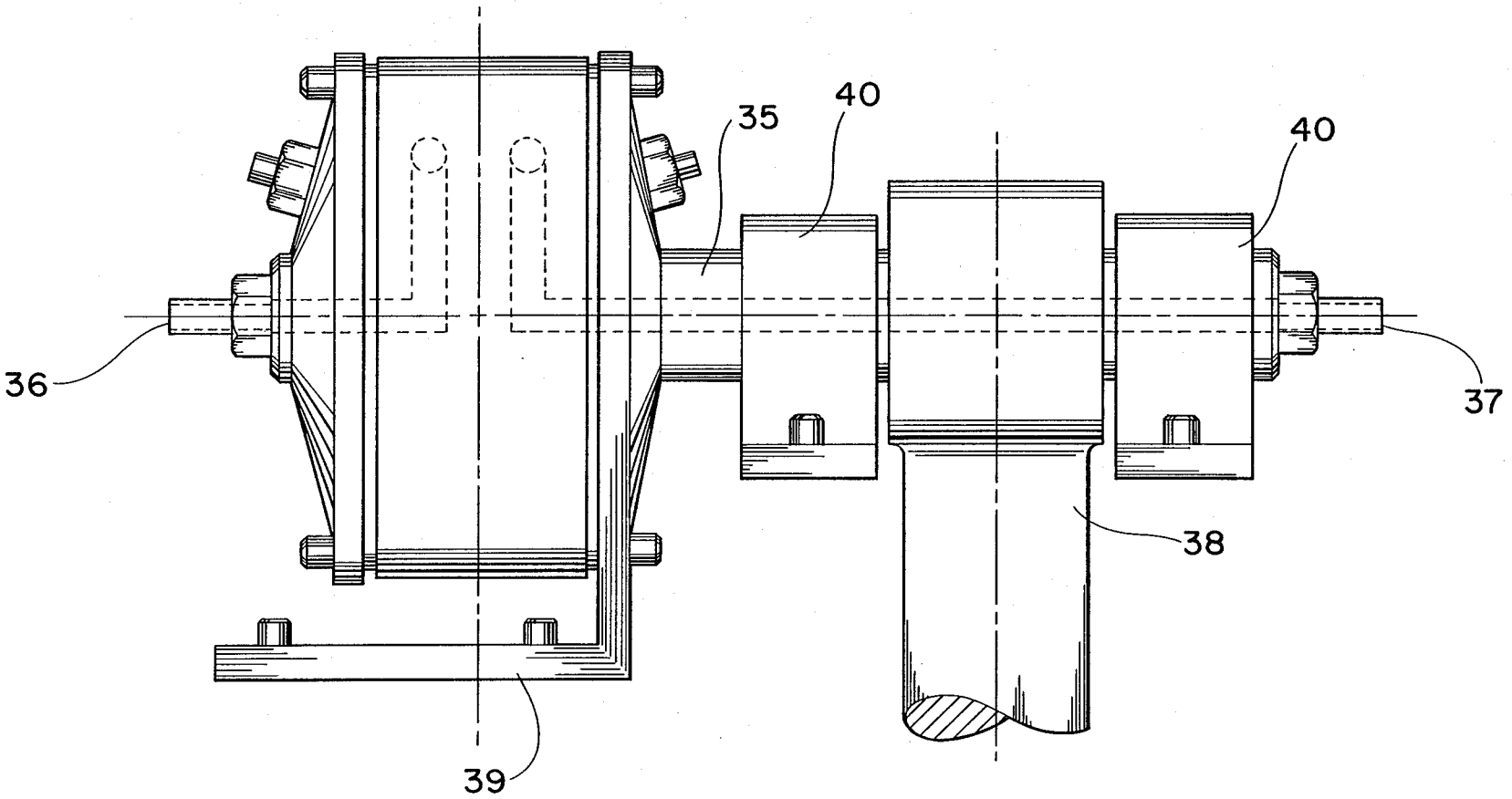
FIG. 5 is a schematic side view of the housing which is stationary and the shaft, having rotary movement capability, attached to a retractable landing gear strut.

Pressure enters through hydraulic fitting A 25 from a reservoir/accumulator/valve system not shown nor part of this invention. The fluid flows through axial port A 18 continues into stationary vane port A 21, and exits into the slit between stationary vane surface A 23 and positive stop surface A 30. This forces the free-to-move positive stop 27 to rotate about the stationary shaft 16 along the horizontal axis 17 away from stationary vane surface A 23. As shown in FIG. 1, the positive stop 27, housing 10 and strut 29 are one. Hence, simultaneously, the inside radius of the housing 10 rotates along the outside radius of the stationary vane 20. When cavity A 32 is at its greatest volume and positive stop surface B 31 abuts stationary vane surface B 24 rotary movement ceases and the strut 29 is in the retracted position. FIG. 4 approximates this new position. Continuous pressure provided to cavity A 32 is one of several means of locking the strut 29 in the retracted position.

Concurrent with pressure being introduced into the A cavity 32 existing extend and lock pressure to and in cavity B 33, now at its largest volume, is released. As cavity A 32 enlarges, cavity B 33 reduces to a slit. Fluid in cavity B 33 exits via stationary vane port B 22, axial port B 19 and hydraulic fitting B 26.

To re-extend the strut pressure is once again introduced into cavity B 31 at the same time pressure is released and vented from cavity A 32.

Thus, one can see that the Rotary Cylinder Displacement Mechanism, because of its bi-directional one moving part simplicity, will be a highly reliable and welcome addition to the aerospace field.

While the above description contains many specificities, these should not be construed as limitations on the scope of the invention but rather as an exemplification of one preferred embodiment thereof. Unfortunately, because of its simplicity those skilled in the art can envision many other possible variations, in structure, shape mounting, placement, material, translation, sequence of movement, additions, appendages, utilization and other possible variations within its scope. For example:

A. this invention can be designed and built long and narrow as in the shape of a straw, or narrow through the horizontal axis, as two frisbees connected back to back would look, and all sizes and shapes in between. The housing can be split in half, set side by side, or in line, V-shaped, U-shaped, FIG. 8 shaped, concave, convex or any combination thereof B. the cavities can be ported through the housing, endcaps or anywhere along the shaft or any combination thereof C. control valves can be built into the various parts of the mechanism D. accumulators and or reservoirs can be built into or attached to the mechanism E. the mechanism can be designed as separate from the movable members it will powerthrough any number of couplings or assembly systems F. the mechanism can be designed to power or control the movement in non-aviation related rotary motion requirements such as canal lock gates, garage door openers, automobile doors, hoods, trunks, automatic door openers such as those found in supermarkets, drawbridges loading and lifting devices.

Accordingly, it is requested that the scope of the invention be determined by the appended claims and their legal equivalents, and not by the examples which have been given.

We claim:

1. A one moving part bi-directional rotary displacement landing gear mechanism wherein the improvements comprise:

a pressure operated arrangement housed in an enclosure having bi-directional rotary movement capability;

said enclosure having a built in positive stop with load bearing surfaces;

said positive stop extending away from a horizontal axis to form a landing surface contacting, weight bearing strut;

a shaft, having bi-directional rotary movement capability, extending axially through said enclosure, sealingly riding atop said positive stop and fixedly carrying a sealed vane having load bearing surfaces facing opposite said positive stop load bearing surfaces;

two sealed cavities formed by and occupying the spaces between said load hearing surfaces;

said cavities vent bi-directionally whereby pressure venting into one cavity and concurrently exiting the second cavity produces rotary movement to lower and retract the surface contacting, weight bearing landing strut of aircraft.

2. A one moving part bi-directional rotary displacement landing gear mechanism wherein the improvements comprise:

a pressure operated arrangement housed in an enclosure having bi-directional rotary movement capability;

said enclosure having a built in positive stop with load bearing surfaces;

a shaft, having bi-directional rotary movement capability, extending axially through said enclosure, sealingly riding atop said positive stop and fixedly carrying a sealed vane having load bearing surfaces facing opposite said positive stop load bearing surfaces;

said shaft is affixed surface to a landing contacting, weight bearing strut(s);

two sealed cavities formed by and occupying the spaces between said load bearing surfaces;

said cavities vent bi-directionally whereby pressure venting into one cavity and concurrently exiting the second cavity produces rotary movement to lower and retract the wheel surface contacting weight bearing landing gear strut(s) of aircraft.

* * * * *